US005854473A

United States Patent [19]

Malnoe

[11] Patent Number: 5,854,473

[45] Date of Patent: Dec. 29, 1998

[54] INDUCTION HEATING APPARATUS HAVING AN ALTERNATING CURRENT GENERATOR WITH A SATURABLE CHOKE

[75] Inventor: Michel Auguste Malnoe, Saint-Samson, France

[73] Assignee: Moulinex S.A., Bagnolet, France

[21] Appl. No.: 637,721

[22] PCT Filed: Nov. 15, 1994

[86] PCT No.: PCT/FR94/01334

§ 371 Date: Apr. 30, 1996

§ 102(e) Date: Apr. 30, 1996

[87] PCT Pub. No.: WO95/14364

PCT Pub. Date: May 26, 1995

[30] Foreign Application Priority Data

Nov. 15, 1993 [FR] France ..... 93 13587

[51] Int. Cl.[6] ..... H05B 6/06; H05B 6/12

[52] U.S. Cl. ..... 219/626; 219/661; 219/663; 219/670; 323/328; 363/97

[58] Field of Search ..... 219/625, 626, 219/627, 624, 660, 661, 662, 663, 665, 667, 666, 668, 670; 323/328, 329; 363/74, 95, 97

[56] References Cited

U.S. PATENT DOCUMENTS

| | | | |
|---|---|---|---|
| 3,777,100 | 12/1973 | Trine | 219/660 |
| 4,002,875 | 1/1977 | Kiuchi et al. | 219/625 |
| 4,055,740 | 10/1977 | Nakamura et al. | 219/663 |
| 4,320,273 | 3/1982 | Kiuchi | 219/626 |
| 4,506,131 | 3/1985 | Boehm et al. | 219/662 |
| 5,055,648 | 10/1991 | Iceland et al. | 219/667 |
| 5,059,762 | 10/1991 | Simcock | 219/662 |

FOREIGN PATENT DOCUMENTS

| | | | |
|---|---|---|---|
| 4-337280 | 11/1992 | Japan | 219/625 |

*Primary Examiner*—Philip H. Leung
*Attorney, Agent, or Firm*—Young & Thompson

[57] ABSTRACT

A ripple current generator for an induction heating apparatus includes a resonant circuit with a current injecting self-inducting coil (6), a capacitor (13), an induction heating coil (14) and a high-frequency controlled power switch (12). The current injecting self-inducting coil (6) is saturable and mounted in series with a parallel assembly consisting of two arms; a first arm ($B_1$) containing the switch (12) and a second arm ($B_2$) containing a capacitor (13) mounted in series with the induction heating coil (14). The self-inducting coil includes a magnetic circuit that automatically reaches saturation during the resonance phase of the oscillating circuit. The generator is useful in household cooking appliances such as induction plates, cookers or deep fryers, as well as industrial induction heating equipment for treating metal components.

13 Claims, 7 Drawing Sheets

INDUCTION HEATING APPARATUS HAVING AN ALTERNATING CURRENT GENERATOR WITH A SATURABLE CHOKE

BACKGROUND OF THE INVENTION

The present invention relates to an alternating current generator, intended to be used in an induction-heating apparatus. Generators of this type are known and the one described in the present application includes an oscillating circuit consisting of a current-injection choke, a capacitor, an induction-heating coil and a power switch controlled at high frequency.

The principle of induction heating is known and consists in applying a current which varies at a relatively high frequency, up to a few tens of kilohertz, to a coil which serves as inductor and which is placed in proximity to a body of an electrically conducting object so that eddy currents are developed therein, and which generates a considerable amount of heat therein joule effect. The existing devices employing this heating principle exhibit the drawback of being sensitive to the coupling, that is to say that the heating power transmitted varies when the dimensions of the object to be heated vary. More particularly, it is known that, when such generators are used in induction plates intended to heat food contained in a receptacle, the maximum heating power transmitted to the receptacle containing the food to be heated is the smaller the smaller the diameter of the base of this receptacle.

In order to remedy this drawback, several solutions have been implemented, some of which vary the inductance of the oscillating circuit so as to modulate the power transmitted. Other techniques use mechanical methods consisting in altering the spacing gap between the inductor and a support plate situated in proximity to the inductor and on which the receptacle is placed, which leads to a variation of the gap containing the support plate, and consequently a variation in the magnetic flux through this gap. Other known solutions consist in varying the output frequency of a semiconductor inverter feeding the induction-heating coil. Solutions are also known consisting in adjusting the DC power supply voltage of the inverter by using a phase-control rectifier in the rectifier circuit. Another solution used consists in varying, in steps, the capacitance and inductance parameters of the switching circuit.

All these solutions, although they allow modulation of the heating power, do not, however, make it possible to avoid the influence of the size of the body to be heated on the power transmitted by the inductor to this body. In fact, as we mentioned previously in the case of the heating of food contained in a cooking receptacle, this influence is manifested by a lowering in the power absorbed when the surface area of the receptacle to be heated, in which the eddy currents are developed, is reduced. This constitutes a drawback for the user, who wants to have high power available in small-size receptacles.

SUMMARY OF THE INVENTION

The object of the invention is to produce a device which makes it possible to induce a power which does not depend on the dimensions of the body to be heated and which makes it possible to obtain high heating power even for cooking receptacles of small dimensions.

According to the invention, the generator described here includes a current-injection choke of the saturable type mounted in series with a parallel assembly formed by two branches, that is a first banch $B_1$ containing the power switch, and a second branch $B_2$, containing the capacitor mounted in series with the induction-heating coil.

The device according to the invention thus makes it possible to vary the power continuously from a low value of about 100 watts to a value of about 2.5 kilowatts whatever the size of the receptacle used. This advantage is vital in the case of a domestic use of the generator in an induction heating hob, where the low powers, often necessary for simmering, are obtained without cycling.

Another essential advantage of the generator according to the invention resides in the use of a current-injection choke which is saturable by construction, requiring no additional device for reaching saturation, and which operates automatically in saturation during the resonance phase of the oscillating circuit. in addition to the reduction in the size and in the price, an important consequence of the use of such a saturable choke is that auto-adaptability of the generator to the load is obtained. In effect, in contrast to the analogous devices of the prior art, in which the power absorbed by the body to be heated diminishes when the dimensions of this body diminish, the generator according to the invention makes it possible to obtain heating power independent of the dimensions of the body to be heated, capable of varying in a wide range, and the value of which is chosen solely by the user.

BRIEF DESCRIPTION OF THE DRAWINGS

The characteristics and advantages of the generator according to the invention will emerge from the description which follows, by way of non-limiting example, with reference to the attached figures in which.

DETAILED DESCRIPTION OF PREFERRED EMBODIMENT

Figure 1:
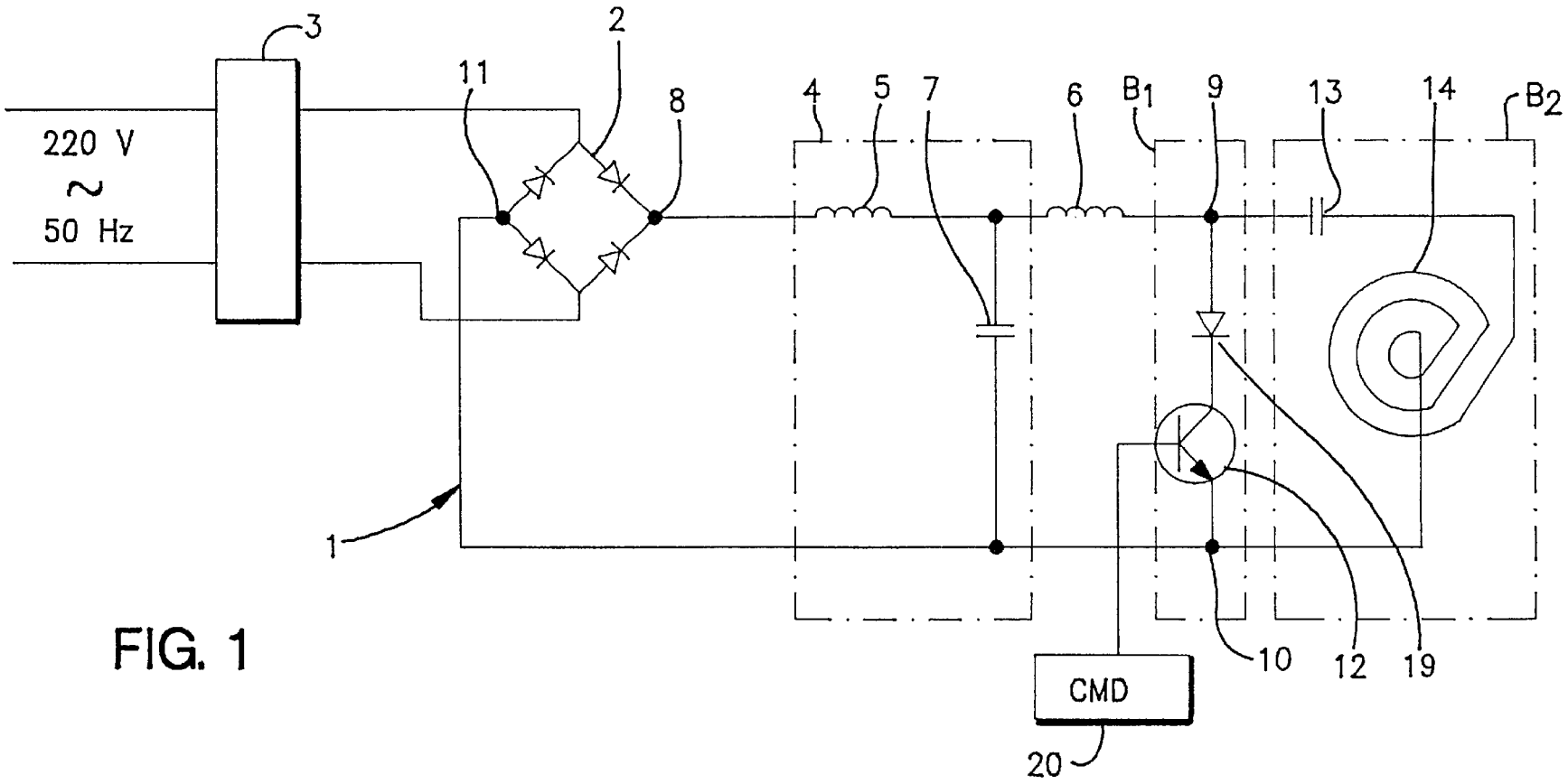
FIG. 1 represents the diagram of an embodiment of the generator according to the invention, in which the power switch used is a power transistor of the IGBT type, associated with a power dioide.

As represented in FIG. 1, the alternating current generator 1 is intended to be used in an induction-heating apparatus of the hotplate type and is supplied by the mains, the said generator comprises, in a manner known per se, a rectifier bridge 2 preceded by an anti-interference filter 3 and followed by a low-pass filter 4, comprising a coil 5 and a capacitor 7. A first output terminal 8 of the said rectifier bridge 2 is linked to a first terminal of the coil 5, the second terminal of the coil 5 being linked to a terminal common to a current-injection choke 6 and the capacitor 7. The second terminal 9 of the current-injection choke 6 is linked to a first terminal of the parallel assembly consisting of two branches $B_1$ and $B_2$. The second terminal 10 of this parallel assembly is linked to the second terminal of the capacitor 7 and to the second output terminal 11 of the rectifier bridge 2. The branch $B_1$ comprises an electronic switch 12, while the branch $B_2$ comprises a capacitor 13 mounted in series with a coil forming the inductor 14.

The coil 5 and the capacitor 7 constitute the low-pass filter 4 which makes it possible to avoid steep voltage fronts possibly appearing in the oscillating circuit returning towards the mains.

Figure 2:
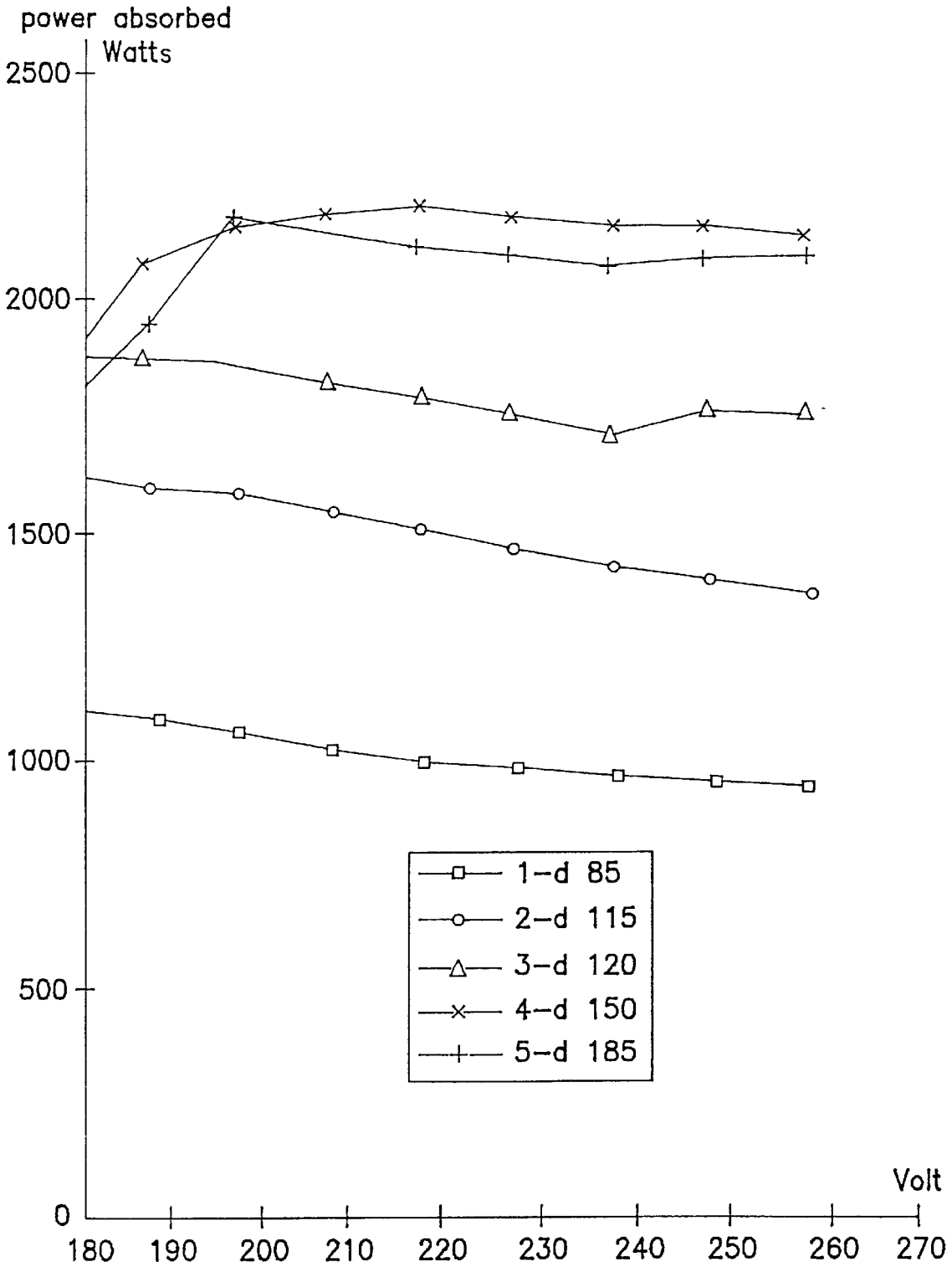
FIG. 2 illustrates a graph showing the development of the power absorbed as a function of the power supply voltage of different diameters d, in cm, of the utensil containing the food to be heated in the case of a generator of the prior art including a non-saturable choke.

As can be seen in FIG. 2, the graph represents the power absorbed as a function of the power supply voltage in a generator of the prior art as described above. This graph shows that, when the power supply voltage varies from 180 V to 270 V, the heating power induced does not exceed 2 kilowatts when receptacles are used having diameters ranging from 95 cm to 150 cm.

Figure 4:
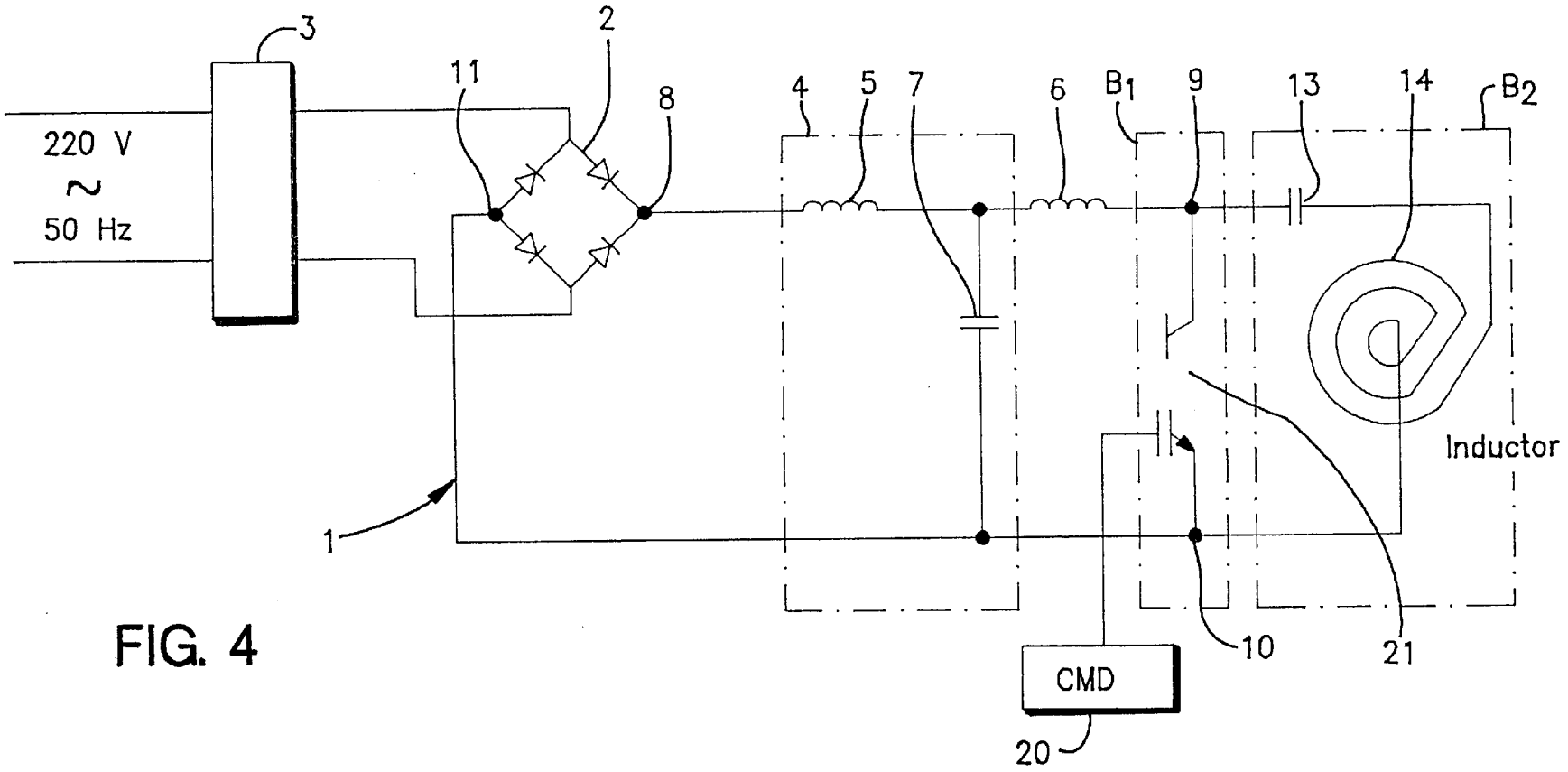
FIG. 4 represents a variant embodiment of the invention in which the switch is a thyristor of the MOS CONTROLLED THYRISTOR (MCT) voltage-symmetric type.
Figure 5A:
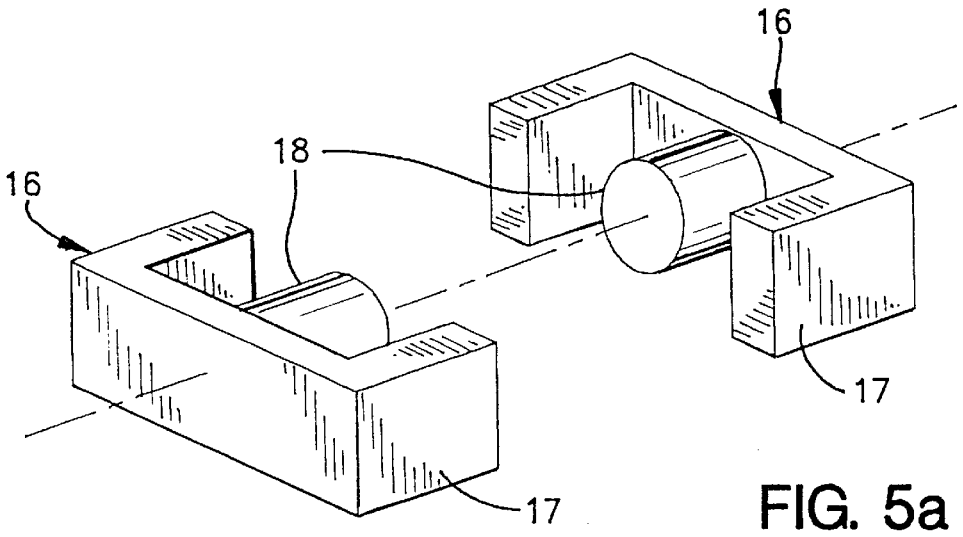
FIG. 5*a* represents a perspective view of the E-shaped ferrite parts constituting the magnetic circuit of the current-injection choke.
Figure 5B:
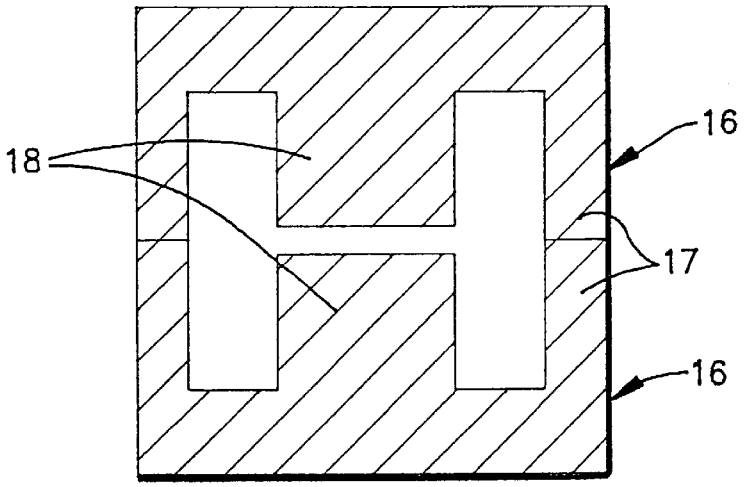
FIG. 5*b* represents a vertical section of the saturable current-injection choke used in the generator according to the invention.
Figure 5C:
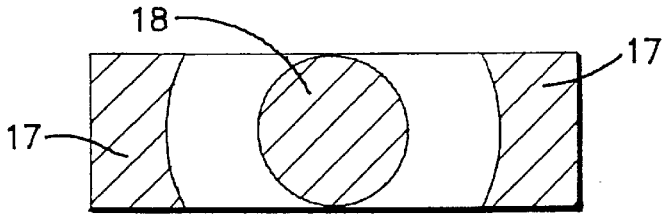
FIG. 5*c* represents a horizontal section of the saturable current-injection choke used in the generator according to the invention.

According to the invention, the current-injection choke is a saturable choke and is mounted in series with a parallel assembly formed by two branches, i.e. a first branch $B_1$ containing the switch referenced 12 in FIG. 1, and 21 in FIG. 4, and a second branch $B_2$ containing a capacitor 13 mounted in series with the induction-feeding coil 14. The choke 6 includes a magnetic circuit which automatically reaches saturation when its winding carries a current of predetermined value. This magnetic circuit, as FIGS. 5*a* and 5*b* show, comprises two identical E-shaped ferrite parts 16 linked by their respective lateral bars 17, while the respective central cores 18 are separated by a 4 mm gap.

According to a preferred embodiment of the invention, the choke 6 is saturable by construction and includes a winding of 46 turns formed by 60 strands of 0.2 mm in diameter. The choke 6 is characterized in that it includes a magnetic circuit which automatically reaches saturation when its winding carries a current of predetermined value. The switch 12 of the branch $B_1$, as illustrated in FIG. 1, is a power transistor of the IGBT type, mounted in series with a power diode 19. The diode 19 allows an inverse voltage to be applied to the terminals of the power transistor when the latter is turned off.

A control device CMD 20 drives the high-frequency switching of the power transistor during the resonance phase of the oscillating circuit, when the current in the branch $B_1$ is zero. The control device 20 also makes it possible to avoid the overvoltage capable of developing at the terminals of the power transistor.

Figure 3:
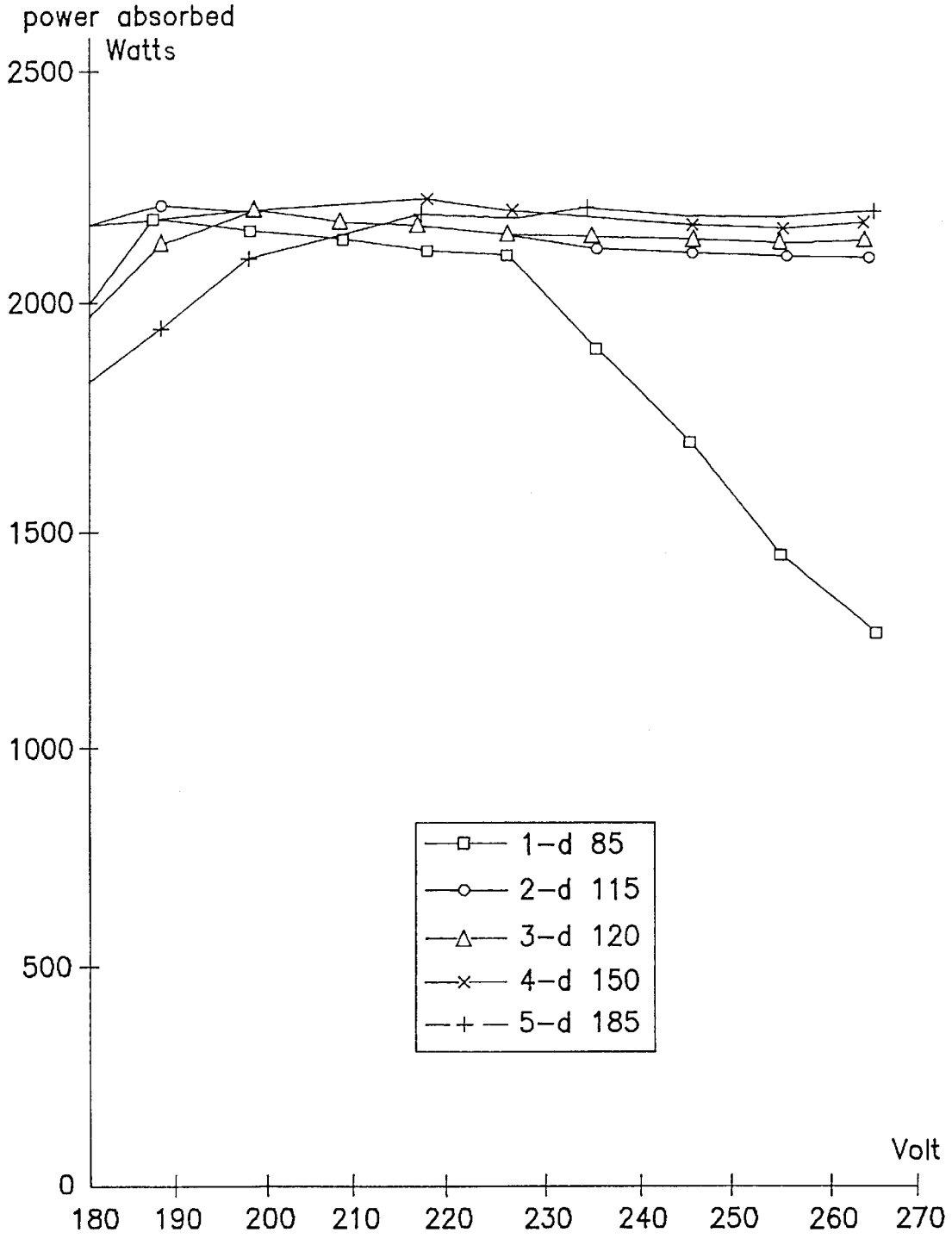
FIG. 3 illustrates the development of the power absorbed as a function of the power supply voltage for different diameters d, in cm, of the utensil containing the food to be heated in the case of the generator according to the invention, and including a saturable choke.

Thus, by virtue of the invention, when the choke 6 is saturable, a generator is obtained which makes it possible to induce a heating power which varies over a wide range, and the value of which does not depend on the dimensions of the receptacle to be heated. As FIG. 3 shows, the power absorbed for different power supply voltages varying from 180 V to 270 V is greater than 2 kilowatts except for the case where the diameter of the kitchen utensil is 95 cm and the power supply voltage is greater than 230 V.

In this latter case, a drop is observed in the power absorbed which is due to the fact that the limit voltage which can be withstood by the switch is reached; this results in automatic regulation of the voltage at the terminals of the switch thus avoiding damage to the switch.

According to a second embodiment illustrated in FIG. 4, in which the elements which are identical to those of FIG. 1 bear the same references, the switch controlled at high frequency is a thyristor 21 of the voltage-symmetric MOS CONTROLLED THYRISTOR (MCT) type. The use of this type of switch makes it possible to dispense with the power diode 19 in the branch $B_1$. Moreover, this embodiment allows a significant enhancement in the efficiency and a reduction in size. In fact, the total voltage drop at the terminals of the branch $B_1$ according to FIG. 1, when it contains the power transistor of the IGBT type 12 in series with the power diode 19 is 6.1 V, whereas in the layout of FIG. 4, in which the branch $B_1$ contains only the MOS CONTROLLED THYRISTOR 21, this voltage drop is only 1.6 V. This results in a gain in power of at least 3.8.

According to a preferred embodiment obtained by trials carried out by the Applicant, the inductance of the saturable choke 6 has a value of 250 $\mu$H, the capacitance of the capacitor 13 has a value of 188 nF, the inductance of the inductor 14 off-load has a value of 66 $\mu$H, and the power switch is chosen such that the breakdown voltage does not exceed 1200 V. Trials have been carried out for a value of the saturation current of the choke 6 of the order of 17 amperes at ambient temperature.

Figure 7:
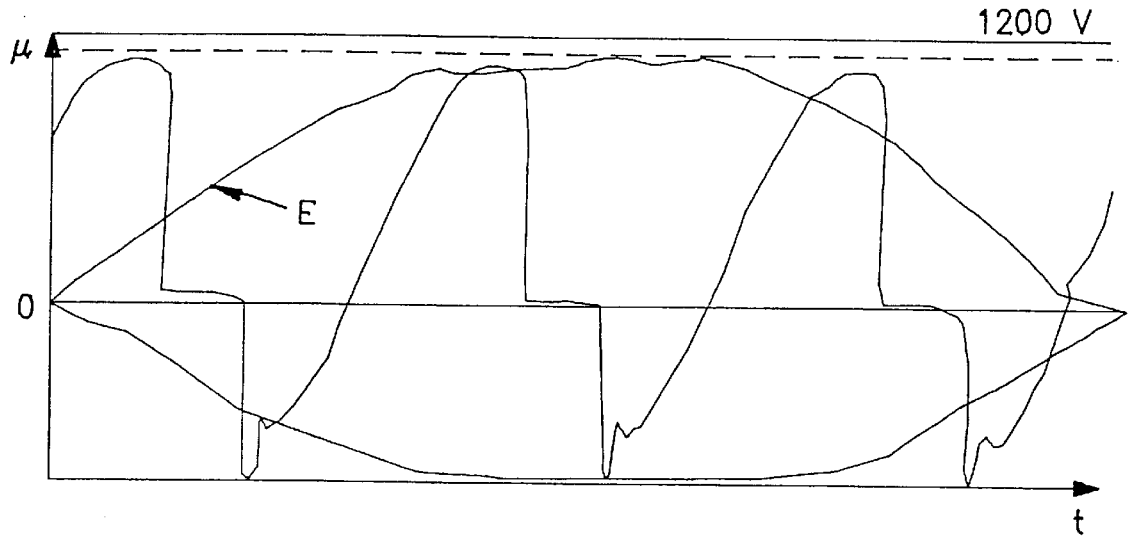
FIG. 7 illustrates an envelope E of the power supply voltage and, to a very much enlarged scale, a part of this said voltage applied to the terminals of the power switch in the case of an oscillating circuit comprising a non-saturable current-injection choke.
Figure 8:
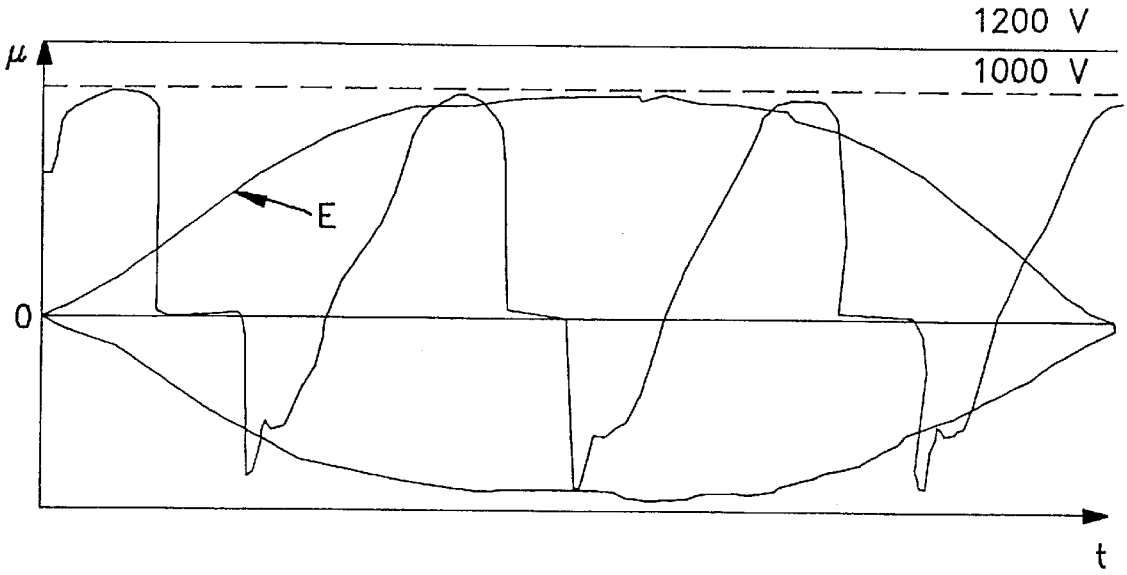
FIG. 8 is a representation analogous to FIG. 7, but in the case of an oscillating circuit comprising a saturable current-injection choke according to the invention.

The trials of FIG. 7 were carried out for a power of 1500 W at a frequency of 29.6 Hz, and the trials of FIG. 8 were carried out for a power of 1500 W at a frequency of 31.5 kHz.

Figure 6:
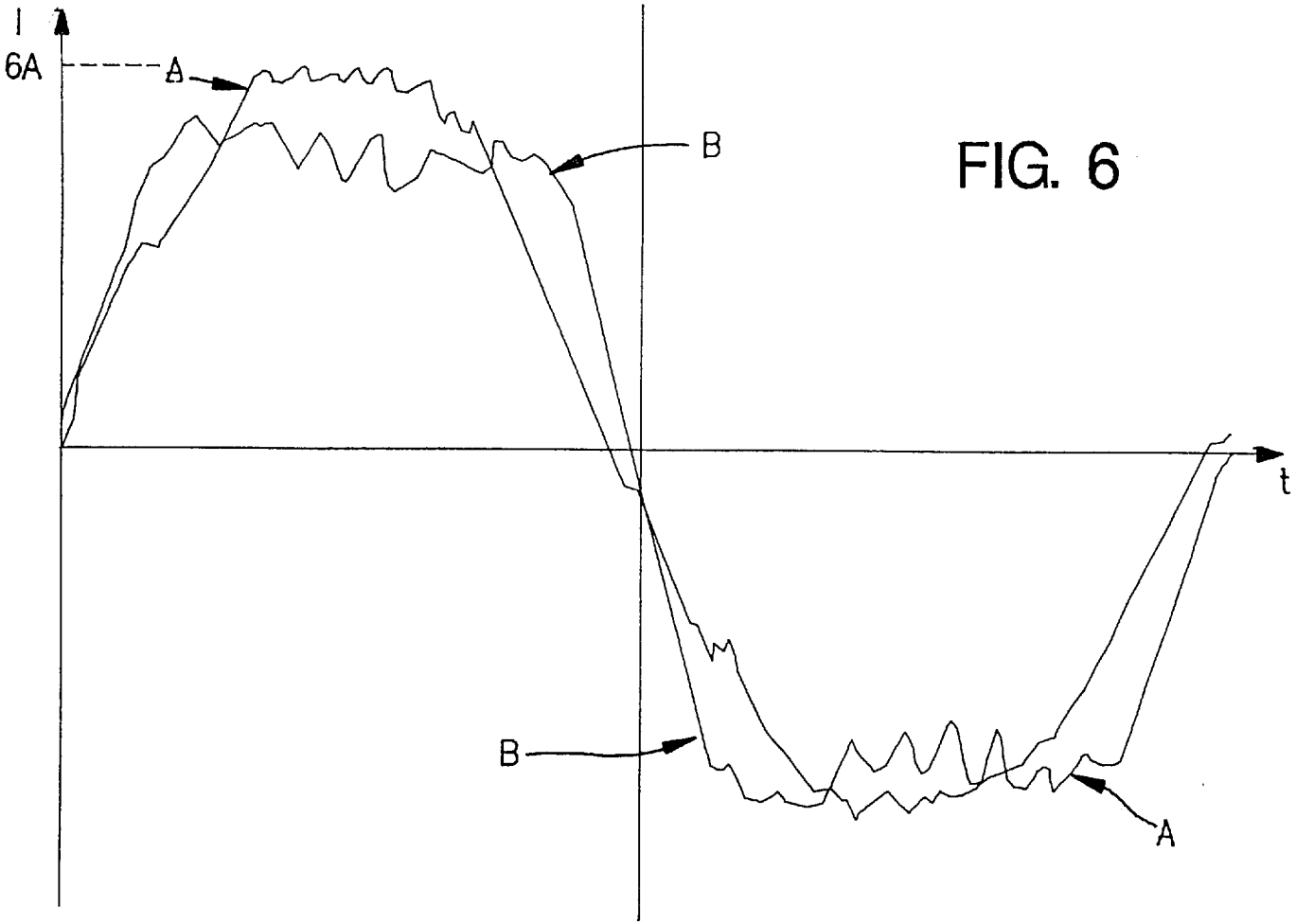
FIG. 6 illustrates, on the one hand, a cycle A of the power supply current flowing in an oscillating circuit consisting of, among other things, a nonsaturable current-injection choke as well as an induction-heating coil and, on the other hand, a cycle B of the power supply current flowing in a circuit of the same type but with a saturable choke according to the invention.

These trials show, according to FIGS. 6, 7 and 8, that, when a saturable choke according to the invention is used, the supply current (curve B), as well as the envelope E of the voltage at the terminals of the branch $B_1$ (FIG. 8) show clipping in contrast to curves A and E (FIG. 7), and that they are sinusoidal in the absence of a saturable choke. In the trial plotted on curve E (FIG. 8), the voltage at the terminals of the branch $B_1$ is very much lower than the breakdown voltage of the power switch, 1200 V in this instance, whereas, in the trial plotted on curve E (FIG. 7), the voltage at the terminals of the branch $B_1$ is substantially equal to the breakdown voltage of the power switch.

The generator according to the invention thus makes it possible to obtain a simple and inexpensive device which operates over a wide power range, and the heating power of which does not depend on the dimensions of the receptacle containing the food to be heated.

This device moreover makes it possible conspicuously to enhance the coefficient of use of silicon for small loads. This allows the user to obtain a high desired power whatever the load, with an economical switch. Moreover, by virtue of the reduction in overvoltage at the terminals of the switch 12, 21, a high power can be maintained in small loads, despite poor coupling.

The invention applies also to induction-heating generators intended to be incorporated into housings of apparatus such as, for example, steamers, rice cookers or deep fryers. It applies also to industrial machines for induction heating intended for treatment of metal parts.

In fact, by virtue of the saturable choke, a small-size electronic circuit is achieved, and high powers are obtained which are suitable for deep fryers, as well as regulated, lower powers which are suitable for cookers with a simmer function or also for steamers.

What is claimed is:

1. An alternating current generator for an induction heating apparatus, the current generator having an oscillating circuit comprising:

a parallel assembly of two branches, a first of said branches comprising a power switch, and a second of said branches comprising a capacitor connected in series with an induction heating coil; and a saturable current injection choke connected in series with said parallel assembly, said current injection choke comprising a magnetic circuit that automatically reaches saturation during a resonance phase of the oscillating circuit.

2. The generator of claim 1, wherein said magnetic circuit comprises a winding and wherein said magnetic circuit is sized to saturate when said winding carries a first current, the first current being carried by said winding during the resonance phase of the oscillating circuit.

3. The generator of claim 2, wherein said magnetic circuit further comprises two identical E-shaped ferrite parts that are connected at their respective exterior lateral bars and that have their respective central cores separated by a gap.

4. The generator of claim 3, wherein said first current is about seventeen amperes.

5. The generator of claim 3, wherein said gap is about four millimeters.

6. The generator of claim 1, wherein said power switch comprises an insulated gate bipolar transistor.

7. The generator of claim 6, wherein said first branch comprises a power diode connected in series with said insulated gate bipolar transistor.

8. The generator of claim 1, wherein said power switch comprises a MOS controlled thyristor.

9. The generator of claim 1, wherein said oscillating circuit further comprises a control device connected to a control electrode of said power switch for controlling high frequency operation thereof when a current in said first branch is zero.

10. The generator of claim 1, wherein said generator further comprises a voltage rectifier bridge connected to an anti-interference filter and to a low-pass filter, said low-pass filter being connected to said current injection choke.

11. A induction cooking appliance comprising:

an induction heating element;

an alternating current generator for providing power to said induction heating element, said current generator having an oscillating circuit comprising, a parallel assembly of two branches, a first of said branches comprising a power switch, and a second of said branches comprising a capacitor connected in series with an induction heating coil, and a saturable current injection choke connected in series with said parallel assembly, said current injection choke comprising a magnetic circuit that automatically reaches saturation during a resonance phase of the oscillating circuit.

12. The appliance of claim 11, wherein said magnetic circuit is sized to saturate when it carries a first current, the first current being carried during the resonance phase of the oscillating circuit.

13. The appliance of claim 12, wherein said first current is about seventeen amperes.

* * * * *